United States Patent [19]

Kodis

[11] 4,011,811

[45] Mar. 15, 1977

[54] MULTIPLE DOCUMENT PRINTING SYSTEM

[75] Inventor: Robert D. Kodis, Brookline, Mass.

[73] Assignee: Di/An Controls, Inc., Boston, Mass.

[22] Filed: Oct. 20, 1975

[21] Appl. No.: 623,566

[52] U.S. Cl. ..... 101/93.07; 101/93.11; 101/90

[51] Int. Cl.[2] ..... B41J 3/24

[58] Field of Search ..... 101/66, 67, 90, 93.07, 101/93.11, 93.12, 93.22, 93.29, 93.30, 93.38–93.40, 93.27, 110; 220/120, 124, 162–166, 181–185

[56] References Cited

UNITED STATES PATENTS

| | | | |
|---|---|---|---|
| 2,824,736 | 2/1958 | Allen | 101/66 X |
| 2,896,531 | 7/1959 | Dodge et al. | 101/66 X |
| 2,991,710 | 7/1961 | Harwood | 101/93.07 |
| 3,267,843 | 8/1966 | Lemelson | 101/93.07 X |
| 3,415,184 | 12/1968 | Perucca | 101/93.21 |
| 3,757,685 | 9/1973 | Woodie et al. | 101/66 |
| 3,890,893 | 6/1975 | Kodis | 101/93.28 X |

*Primary Examiner*—Edward M. Coven
*Attorney, Agent, or Firm*—Morse, Altman, Oates & Bello

[57] ABSTRACT

A printing system with one drive motor and having at least two printing stations located between a print drum and a plurality of ballistic elements for simultaneously printing at least two document blanks independently advanced through the printing stations by pinch roller and brake assemblies. The printed documents are engaged by an eject roller assembly and discharged through an exit slot after having been severed by a rotary cutter.

12 Claims, 4 Drawing Figures

MULTIPLE DOCUMENT PRINTING SYSTEM

BACKGROUND OF THE INVENTION

1. Field of Invention

The present invention relates to high speed printing systems and, more particularly, is directed towards multiple document, high speed printing systems.

2. Description of the Prior Art

A variety of high speed printers have been designed for use with electronic computers for printing various types of information such as airline tickets. One type of printer suitable for operation with a computer utilizes a print drum having type disposed about its periphery and a plurality of magnetically actuated hammers. The print drum is rotated continuously by a drive motor. The ticket stock is advanced by feed rollers into a print station between the print drum and the hammers. Printing is accomplished by actuating the hammers when a particular type character is at a given position and urging the ticket stock against the print drum. Such printers are capable of printing on one document at a time. If more than one document is to be printed, the document stock is removed and new stock is threaded into the printer. The process of changing stock is a time consuming task. In order to overcome this problem, more than one printer is used, each printer having a print drum, a drive motor for continuously rotating the drum and a set of magnetically actuated hammers. Additionally, each printer includes feed rollers for advancing the blank document, a cutter for severing the printed document, and eject rollers for discharging the cut document. Due to the expenditures involved, the use of multiple printers has met limited success.

SUMMARY OF THE INVENTION

It has been found that a considerable savings can be realized in high speed printing systems if one print drum is utilized for printing more than one document. Accordingly, it is an object of the present invention to simplify and reduce the cost of high speed, printing systems for multiple document printing.

It is another object of the invention to provide a multiple document printing system having a single drive motor and at least two printing stations disposed between a print drum and a plurality of ballistic elements. At least two document blanks are advanced independently by pinch and brakes assemblies to a predetermined position relative to the print stations. The document blanks are incrementally and independently advanced through the printing stations and the ballistic elements are selectively energized for simultaneously printing the documents. Upon completion of the printing cyle, each document is advanced to a selected position where they are simultaneously severed by a rotary cutter and dispensed from the system by an eject assembly.

Other objects of the present invention will in part be obvious and will in part appear hereinafter.

The invention accordingly comprises the devices, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
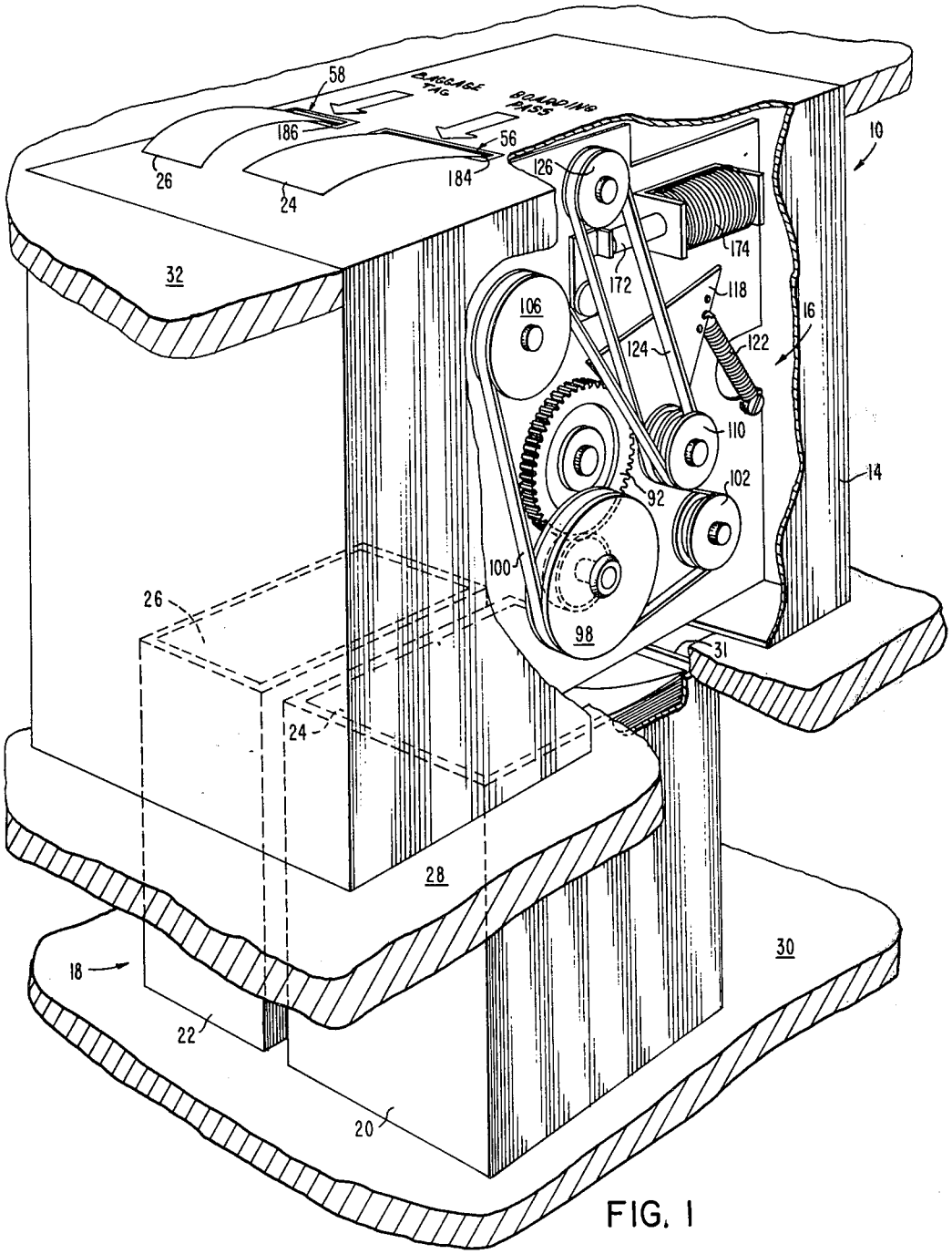
FIG. 1 is a perspective view, partly cutaway, of a printing system embodying the invention.

Referring now to the drawings, particularly FIG. 1, there is shown a high speed, on-the-fly printing system 10 embodying the present invention for simultaneously printing and dispensing a plurality of documents for various uses. In the illustrated embodiment, printing system 10 is an airline departure terminal that is interconnected with an on-line, real time, communications system terminal 12. Departure terminal 10 comprises a housing 14 in which there is mounted a multiple document printer 16 and a storage assembly 18 which contains blank documents to be printed. By way of example, departure terminal 10 prints and dispenses boarding passes and baggage tags. Storage assembly 18 includes hoppers 20 and 22 which contain an endless web of boarding pass blanks 24 and an endless web of baggage tag blanks 26, respectively, each blank being fanfolded in its respective hopper in a Z-configuration. Housing 14 and hoppers 20, 22 are supported on shelves 28 and 30, respectively, the upper face of housing 14 being substantially flush with the top of a counter 32. Shelf 28 is formed with an opening 31 through which boarding pass blanks 24 and baggage tag blanks 26 are fed to multiple document printer 16. Hopper 20 and 22 are open-ended containers having substantially rectangular profiles.

Figure 3:
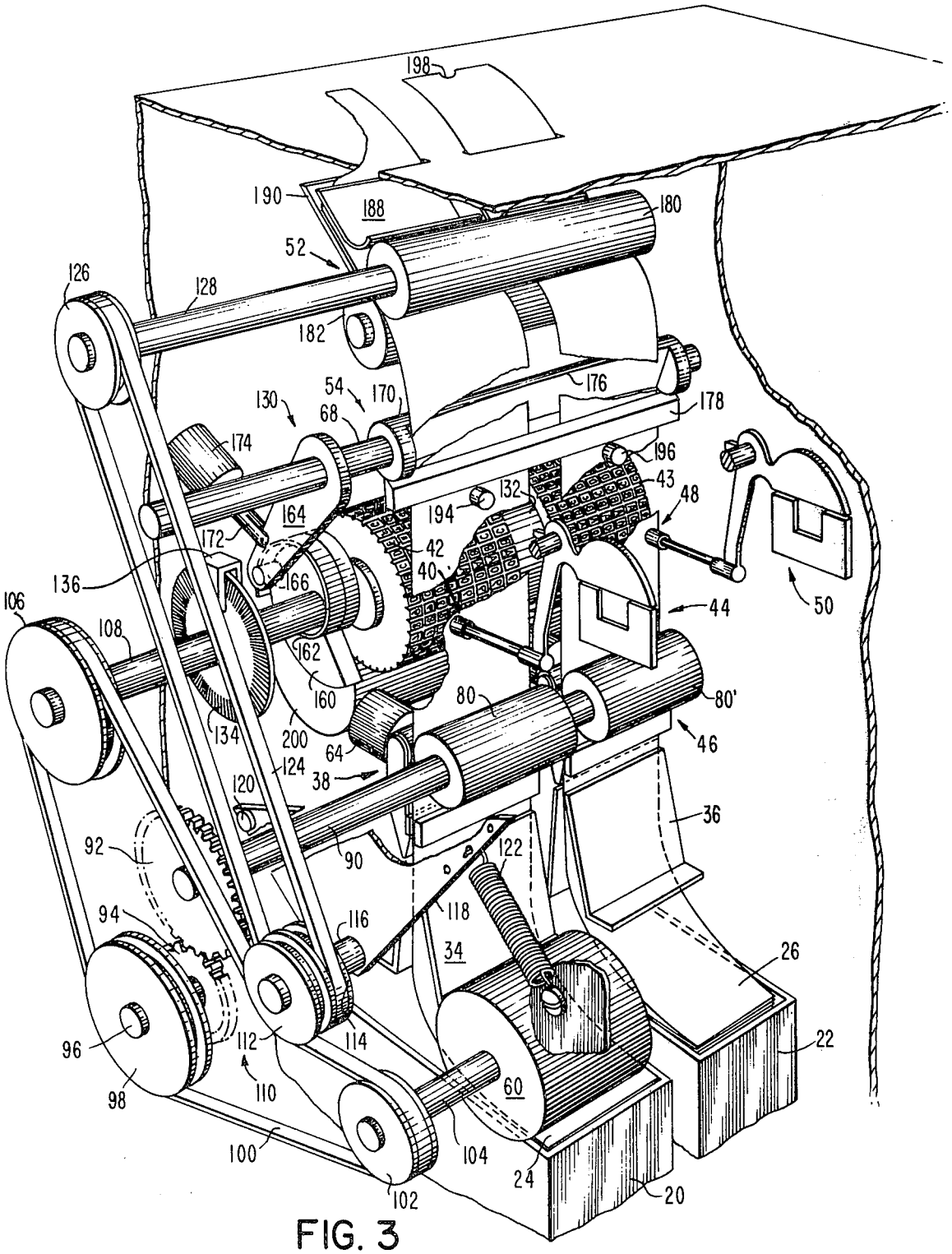
FIG. 3 is a schematic diagram in perspective illustrating certain principles of the invention.
Figure 4:
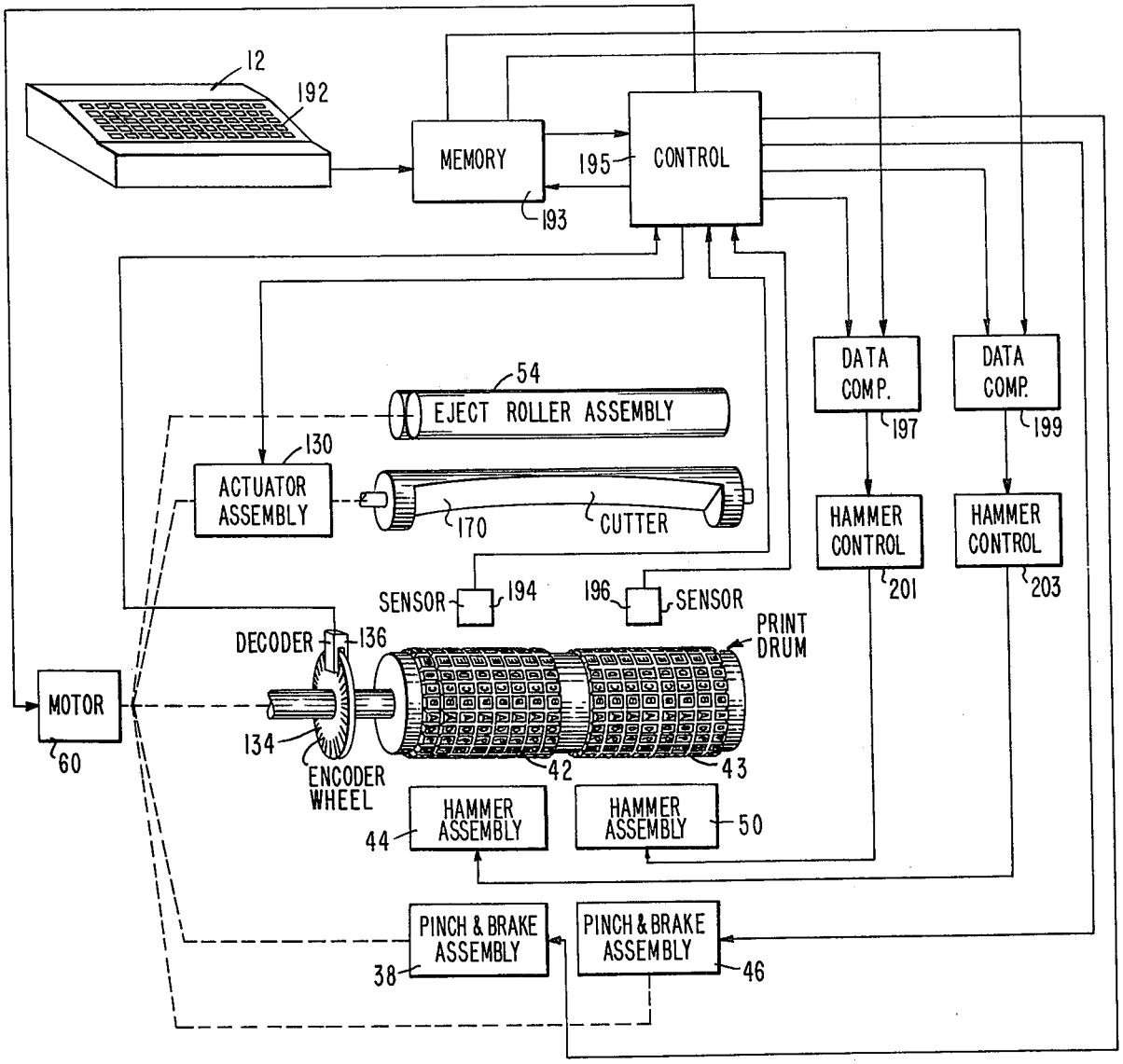
FIG. 4 is a schematic and block diagram of the printing system of FIG. 1.

As best shown in FIG. 3, boarding pass blanks 24 and baggage tag blanks 26 are received within guides 34 and 36, respectively, which extend downwardly from housing 14 in registration with the open ends of hoppers 20 and 22. A pinch and brake assembly 38 feeds boarding pass blanks 24 into a print station 40 between a print drum 42 and a ballistic hammer assembly 44. A pinch and brake assembly 46 feeds baggage tag blanks 26 into a print station 48 between a print drum 43 and a ballistic hammer assembly 50. Printing is accomplished by selectively energizing ballistic hammer assemblies 44 and 50 as the boarding pass blanks and baggage tag blanks are incrementally advanced through their respective print stations. When the printing cycle is completed, the boarding pass and baggage tag are slewed to a predetermined position and are engaged by an eject roller assembly 52. Although the document blanks are printed simultaneously, the printing of one blank may be completed before the printing of the other blank. In this case, the first completely printed blank is slewed to the predetermined position and waits there until the other blank is completely printed. When both the printed boarding pass and the printed baggage tag are at the predetermined position, a rotary cutter assembly 54 severs the printed documents. The severed boarding pass and baggage tag are fed through guides 56 and 58, respectively, by eject roller assembly 52

Figure 2:
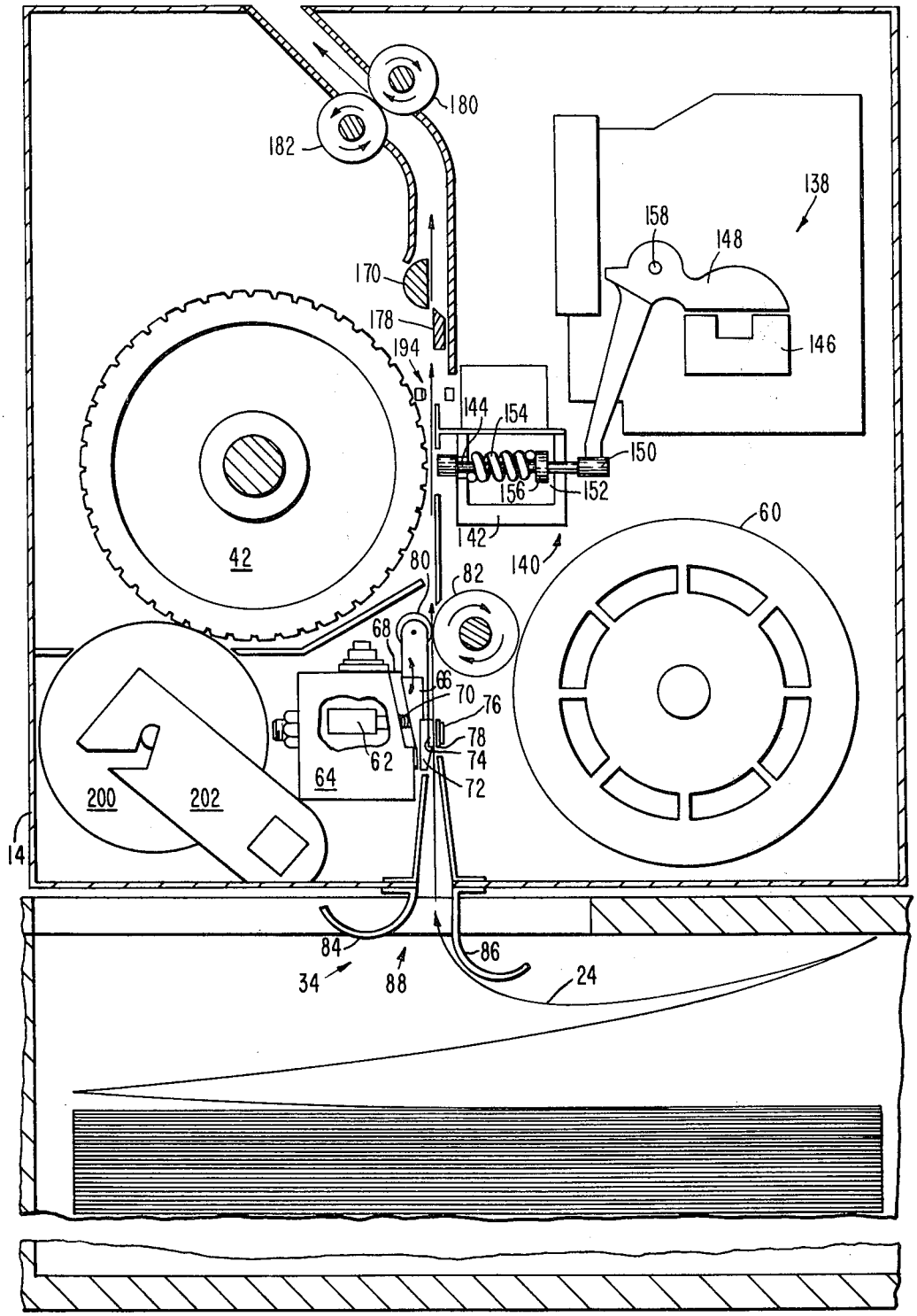
FIG. 2 is a side elevation of the printing system of FIG. 1.

Printer 16 includes a single drive motor 60 which is operatively connected to pinch and brake assemblies 38,46; print drums 42 and 43; rotary cutter assembly 54; and eject roller assembly 52. As best shown in FIG. 2, pinch and brake assembly 38 includes an actuator 62, for example a solenoid, which is mounted to a housing 64. A rocker arm 66 is pivotally mounted to housing 64 by means of a resilient arm 68. A bias element 70, for example a spring, is operatively connected to housing 64 and rocker arm 66. An upper brake 72 having a shoe 74 is mounted at one end of rocker arm 66. A lower brake 76 having a shoe 78 is mounted in spaced relationship to brake 72 at an opposite face of boarding pass blanks 24, shoes 74 and 78 being adapted for engagement and disengagement with the boarding pass blanks. An idler capstan 80 is rotatably mounted to the other end of rocker arm 66. A drive capstan 84, which is mounted in spaced relationship to idler capstan 80 on an opposite face of boarding pass blanks 24, is drivingly connected to motor 60.

When pinch and brake assembly 38 is in an inactive state boarding pass blanks 24 are held stationary and when pinch and brake assembly 38 is in an active state boarding pass blanks 24 are advanced. In the inactive state, solenoid 62 is deenergized and spring 70 pivots rocker arm 66. In consequence, shoe 74 is pivoted towards shoe 78 and idler capstan 80 is pivoted away from drive capstan 82. Boarding pass blanks 24 are captively held between shoes 74 and 78. In the active state, solenoid 62 is energized, and the pressure applied by spring 70 against rocker arm 66 is overcome. In consequence, shoe 74 is pivoted away from shoe 78 and idler capstan 80 is pivoted towards drive capstan 82. Boarding pass blanks 24 are frictionally engaged between idler capstan 80 and drive capstan 82. The rotation of drive capstan 82 is such that the boarding pass blanks are pulled out of hopper 20 and are advanced towards print station 40. Guide 34, which defines a guideway through which boarding pass blanks 24 are threaded, includes a pair of plates 84 and 86 having substantially J-shaped profiles in right cross section. Plates 84 and 86 are mounted to housing 14 at the bottom face thereof in spaced relationship to one another, a substantially triangular shaped entranceway 88 having an enlarged mouth for receiving the boarding pass blanks from hopper 20.

Pinch and brake assembly 46 is similar in construction to pinch and brake assembly 38, the former operative to advance baggage tag blanks 26 from hopper 22 and the latter operative to advance boarding pass blanks 24 from hopper 20. Corresponding parts of pinch and brake assemblies 38 and 46 are denoted by like reference characters and are distinguished from one another by a primed notation. Drive roller 80 of pinch and brake assembly 38 and a drive roller 80' of pinch and brake assembly 46 are mounted on a common shaft 90 having a gear 92 which is engaged by a gear 94 on a shaft 96. A pulley 98, which is configured to drivingly engage an endless belt 100, is mounted to shaft 96. Endless belt 100 is threaded about a pulley 102 which is connected to a shaft 104 of motor 60 and a pulley 106 which is connected to a shaft 108. A pulley assembly 110, which includes a pair of pulleys 112 and 114, is rotatably mounted to a shaft 116 extending from a clutch plate 118. Pulley 112 engages endless belt 100. Plate 118 has a substantially triangular profile and is pivotally mounted to housing 14 by a pin 120. One end of a bias element 122, for example a spring, is attached to plate 118 and the other end of the spring is fixed to housing 14. An endless belt 124 is threaded about pulley 114 and a pulley 126 which is mounted to a shaft 128 that is operatively connected to eject roller assembly 52. Clutch plate 118 is operative to control the tension applied to endless belt 100. Pulley 106 rotates shaft 108 which carries print drums 42, 43 and an actuating mechanism 130 for rotary cutter assembly 52.

Print drum 42 includes rows of characters defining a raised column of printing elements arcuately disposed about the periphery of the drum, adjacent rows being in spaced parallel relationship to one another. Print drum 43 includes rows of characters defining a raised column of printing elements arcuately disposed about the periphery of the drum, adjacent rows being in spaced parallel relationship to one another. Print drums 42 and 43 are mounted to shaft 108 and rotate therewith, a gap 132 separating the rows of characters on each drum. Preferably, print drums 42 and 43 constitute an integral structure that is formed with at least two sets of characters, one set of characters for printing each document. In alternative embodiments, print drums 42 and 43 constitutes separate print drums that are fixed to a common shaft, each print drum having a set of characters for printing each document. It is to be noted that one set of characters is provided for each document to be printed. As illustrated in FIG. 3, shaft 108 carries an encoding wheel 134 which is coded to correspond to the characters on print drums 42 and 43. A decoder 136 reads the coded signals on encoding wheel 134 and generates data signals representing print drum position signals which are used for selectively actuating ballistic hammer assemblies 44 and 50.

Each ballistic hammer assembly constitutes a set of free-floating ballistic elements. Each free-floating ballistic element includes a ballistic hammer 138 and an impactor 140. As shown in FIG. 2, ballistic hammer 138 includes a housing 142 and a hammer 144. Impactor 140 includes an electromagnetic actuator 146, an impactor arm 148 and an impactor head 150. Housing 142 is formed with a guideway 152 which is adapted to slidably receive hammer 144. A bias element 154, for example a compression spring, is spiraled about hammer 144 within guideway 152. A retaining ring 156 is mounted to hammer 144 for holding spring 154 in such a manner that hammer 144 is biased downwardly within guideway 152. When actuator 146 is energized, impactor arm 148, which is pivoted about a pin 158, is pulled toward actuator 146, whereby impactor head 150 urges hammer 144 forward within guideway 152. Thereafter, impactor arm 148 decouples from hammer 144 and returns to a rest position. Hammer 144 continues its forward flight to strike the underside of the document blank, momentarily forcing the document against a raised character on the print drum. Hammer 144, aided by its compressed control spring 154, bounces back and the control spring assures a return to the rest position. One set of free-floating ballistic elements is provided for each set of print drum characters and one ballistic element is provided for each row of print drum characters. In the illustrated embodiment, there is two sets of print drum characters and two sets of ballistic elements. In alternative embodiments, the number of sets of print drum characters and ballistic elements is other than two, for example, three, four, five or more.

Referring again to FIG. 3, it will be seen that rotary cutter assembly 54 comprises a cam plate 160 having an eccentric cam track 162 is mounted to shaft 108. A crank arm 164 having a cam follower 166 is mounted to a shaft 168 having a cutter 170 mounted thereto. An extending arm 172 of an actuator 174 is mounted to crank arm 164. When actuator 174 is energized, cam follower 166 is engaged by cam track 162 and cutter 170 is rotated. Cutter 170 is formed with a concave cutting edge 176 which engages printed blanks 24 and 26 when cutter 170 is engaged by cam track 162. A cutter block 178 is mounted in registration with cutting edge 176, blanks 24 and 26 being threaded between cutter 170 and block 178. In consequence, when cutter 170 is rotated, the blanks are severed simultaneously by the scissor-like action of cutting edge 176 and cutting block 178.

The severed printed document 24 and 26 are dispensed from the printing system by means of eject roller assembly 52 which includes a drive roll 180 and an idler roll 182 for frictionally engaging the printed documents. Drive roll 180 is mounted to shaft 128 and is continuously rotated by endless belt 124. Document blanks 24 and 26 are threaded between drive roll 180 and idler roll 182 and exit through slots 184 and 186, respectively. A pair of plates 188 and 190 constitute a guideway through which printed boarding passes 24 are fed into slot 184. Although not shown, a pair of plates are provided for feeding printed baggage tags 26 into slot 186. The printed boarding pass and printed baggage tag advance between drive roll 180 and idler roll 182 during the printing cycle but are not ejected from the printing system until severed by rotary cutter assembly 52. Eject assembly 52 maintains the printed documents in a stressed condition to enhance cutting.

In one example of system operation, one boarding pass 24 and two baggage tags 26 are to be printed. An operator energizes communications terminal 12, for example a keyboard, by selectively depressing keys 192. Data signals generated by terminal 12 are stored in a memory 193 which feeds a controller 195. Signals generated by controller 195 energize motor 60 and pinch and brake assemblies 38 and 46. Next, boarding pass blanks 24 and baggage tag blanks 26 are slewed to a selected position by their respective pinch and brake assemblies. The selected position is determined by head of form sensors 194 and 196 that sense indicia 198 on boarding pass blanks 24 and baggage tag blanks 26. In the illustrated embodiment, by way of example, each head of form sensor includes a light source and photodetector mounted on opposite sides of the blanks. Indicia 198 is a hole formed in the blanks at selected intervals. Light from the light source is detected by the photodetector when the hole passes as the blanks advance. Pinch and brake assemblies 38 and 46 are deenergized and blanks 24 and 26 are stopped. Boarding pass blanks 24 and baggage tag blanks 26 are now in position in print stations 40 and 48 for printing the first row of characters thereon. Next, ballistic hammer assemblies 44 and 50 are selectively energized as the proper character on print drums 42 and 43 are opposite the free-floating ballistic elements. Print drums 42 and 43 rotate continuously and the ballistic elements urge the document blanks against the print drums when the character to be printed is opposite the ballistic element as determined from encoder wheel 134. That is, a comparison is made in data comparators 197 and 199 between the data signal generated by keyboard 12 and character position signals generated by decoder 136. When a comparison is made, hammer controls 201 and 203 are energized for actuating hammer assemblies 44 and 50, respectively. Ink is supplied to each print drum 42 and 43 by means of an ink roller 200 rotatably mounted to a bracket 202 fixed to housing 14. After the first row of characters is printed on each blank, pinch and brake assemblies 38 and 46 are energized for incrementally advancing the boarding pass blanks 24 and baggage tag blanks 26 through their respective print station. As each blank is incrementally stepped, another row of characters is printed. the cycle continues until all the characters have been printed on each blank. If the printing of one blank is completed before the printing of the other blank, the printed blank is slewed by energizing its pinch and brake assembly until the next indicia 198 is sensed by the head of form sensor. When the other blank is printed completely, it is slewed by its pinch and brake assembly until the next indicia 198 is sensed by the head of form sensor. It is to be noted that the blanks are printed simultaneously until the printing is completed on at least one of the blanks. Next, rotary cutter assembly 54 is acutuated by a signal generated by controller 195 and applied to actuator assembly 130. The printed boarding pass and baggage tag are severed simultaneously and dispensed from the printing system by eject roller assembly 54. In the illustrated example, two baggage tags are to be printed. Therefore, pinch and brake assembly 46 is energized for incrementally advancing another baggage tag blank 26 through print station 48 until the printing of the second baggage tag is completed. It is to be noted, while the second baggage tag is being printed, print and brake assembly 38 is deenergized and boarding pass blanks 24 are held fixed. When the second baggage tag is printed, it is slewed until the next indicia 198 is sensed by head of form 196. Rotary cutter assembly 54 is actuated and the second baggage tag is dispensed. In the manner just described, the operator can print as many boarding passes and baggage tags as needed. As previously indicated, if more than two document blanks are to be printed, the printing system is provided with more than two print drums, the number of each document to be printed being controlled by the operator.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A system for simultaneously printing as least two document blanks, said system comprising:

a. a motor;

b. cylindrical print drum means rotated by said motor, said print drum means having at least two sets of characters disposed in rows and arcuate columns about the periphery thereof;

c. ballistic hammer means for each said set of characters, a first print station located between one of said set of characters and one of said ballistic hammer means, a second print station located between the other of said set of characters and the other of said ballistic hammer means, said first and second print stations juxtaposed along a line that is parallel to the rotational axis of said print drum means, said first print station receiving one of said document blanks, said second print station receiving the other of said document blanks;

d. feed means operatively connected to said motor for independently advancing each said document blank into and through its respective print station, said print drum means and said ballistic hammer means cooperating to print said document blanks as they pass through their respective print stations;

e. severing means operatively connected to said motor for severing said printed document blanks; and f. dispensing means operatively connected to said motor for dispensing said severed printed document blanks.

2. The system as claimed in claim 1 wherein said feed means includes first and second pinch and brake means, said first pinch and brake means including first and second means adapted for mutually exclusive engagement and disengagement with one of said documents, said second pinch and brake means including first and second means adapted for mutually exclusive engagement and disengagement with the other of said documents.

3. The system as claimed in claim 2 wherein said first means of said first and second pinch and brake means includes an idler capstan and a drive capstan, said idler capstan and said drive capstan in spaced relationship to one another on opposite faces of said documents; said second means of said first and second pinch and brake means includes a pair of brakes disposed on opposite faces of said documents.

4. The system as claimed in claim 1 wherein said severing means is cutter means, said cutter means including:

a. rotatable cylindrical cutter means formed with an opening defining a cutting edge having a substantially concave profile, said cylindrical cutter means disposed in juxtaposition with one face of said documents, said cutting edge positioned to sever said documents when said cylindrical cutter means is rotated; and b. a solenoid having a reciprocating piston operatively connected to said cylindrical cutter means, said solenoid having energized and deenergized states;

c. said piston retracted into said solenoid when energized, said cylindrical cutter means rotating when said piston is retracted, said concave cutting edge engaging and severing said documents when said cylindrical cutter means is rotated.

5. A system for simultaneously printing at least two documents, said system comprising:

a. a drive motor;

b. means for selectively advancing each document, each said advancing means including first and second means adapted for mutually exclusive engagement and disengagement with one of said documents, each said document being advanced when said first means is engaged and said second means is disengaged, each said document being stationary when said second means is engaged and said first means is disengaged, said advancing means operatively connected to said motor;

c. a print drum having at least two sets of raised characters disposed about its periphery in rows and arcuate columns;

d. ink impregnated means adapted for engagement with said print drum for transferring ink thereto;

e. at least two sets of ballistic element means, a first set of ballistic element means mounted in spaced registration with one set of characters and a second set of ballistic element means mounted in spaced registration with the other set of characters, each said set of ballistic element means having energized and deenergized states;

f. third means electrically communicating with each said advancing means for controlling each said first and second means;

g. fourth means electrically communicating with said third means and each set of ballistic element means for controlling the state of each said set of ballistic element means, said fourth means including a plurality of data comparators and a plurality of ballistic element controls, one each of said plurality of data comparators and one each of said plurality of ballistic elements controls being associated with one each of said rows of characters;

h. encoder means coupled to said print drum for generating selected signals representing the position of each said character, said encoder means electrically connected to said third means;

i. each said advancing means moving its respective document to a first position between said print drum means and ballistic element means in response to signals generated by said third means;

j. said fourth means receiving signals from said third means and, in response thereto, generating signals for energizing selected ones of said ballistic element means, said signals received from said third means being responsive to said selected signals generated by said encoder means;

k. portions of each said document in registration with an energized ballistic element means being pressed against the character in spaced registration with said energized ballistic element means, whereby the character is printed on said documents;

l. rotary cutter means electrically communicating with said third means, said cutting means responsive to a first signal generated by said third means, said rotary cutter means operating to sever simultaneously each said printed document; and m. eject means operatively connected to said motor and electrically communicating with said third means, said eject means operating to engage said documents, said documents being in a stressed state when engaged by said eject means, said documents dispensed from said system by said eject means when severed by said rotary cutter means.

6. The system as claimed in claim 5 wherein each said advancing means includes first and second pinch and brake means, said first pinch and brake means including first and second means adapted for mutually exclusive engagement and disengagement with one of said documents, said second pinch and brake means including first and second means adapted for mutually exclusive engagement and disengagement with the other of said documents.

7. The systems as claimed in claim 6 wherein said first means of said first and second pinch and brake means includes an idler capstan and a drive capstan, said idler capstan and said drive capstan in spaced relationship to one another on opposite faces of said documents; said second means of said first and second pinch and brake means includes a pair of brakes disposed on opposite faces of said documents.

8. The system as claimed in claim 5 wherein said rotary cutter means includes:

a. cylindrical cutter means formed with an opening having a substantially concave cutting edge adapted to engage said documents;

b. a cam plate having an eccentric cam track operatively connected to said cylindrical cutter means, said cam plate rotated by said motor;

c. a crank arm having a cam follower adapted for engagement and disengagement with said cam track; and d. means for moving said crank arm towards said cam plate, said cam follower engaging said cam track when said crank arm is moved towards said cam plate, said cylindrical cutter means being rotated when said cam follower engages said cam track, said documents being severed when engaged by said concave cutting edge.

9. The system as claimed in claim 5 including first and second sensor means electrically communicating with said third means for detecting indicia on each said document, said first sensor means positioned adjacent a travel path of one of said documents, said second sensor means positioned adjacent a travel path of the other of said documents, said first sensor means detecting said indicia on said one of said documents and said second sensor means detecting said indicia on said other of said documents.

10. The system as claimed in claim 9 wherein said indicia are apertures formed at selected intervals in said documents and each said sensor means includes a light source and a detector disposed on opposite faces of said documents.

11. A system for simultaneously printing at least two document blanks, said system comprising:

a. a motor;

b. cylindrical print drum means rotated by said motor, said print drum means having at least two sets of characters disposed in rows and arcuate columns about the periphery thereof;

c. ballistic hammer means for each said set of characters, a first print station located between one of said set of characters and one of said ballistic hammer means, a second print station located between the other of said set of characters and the other of said ballistic hammer means, said first print station receiving one of said document blanks, said second print station receiving the other of said document blanks;

d. feed means operatively connected to said motor for independently advancing each said document blank into and through its respective print station, said print drum means and said ballistic hammer means cooperating to print said document blanks as they pass through their respective print stations;

e. cutter means operatively connected to said motor for severing said printed document blanks; and f. eject means operatively connected to said motor for dispensing said severed printed document blanks;

g. said feed means including first and second pinch and brake means, said first pinch and brake means including first and second means adapted for mutually exclusive engagement and disengagement with one of said documents, said second pinch and brake means including first and second means adapted for mutually exclusive engagement and disengagement with the other of said documents, said first means of said first and second pinch and brake means including an idler capstan and a drive capstan, said idler capstan and said drive capstan in spaced relationship to one another on opposite faces of said document, said second means of said first and second pinch and brake means including a pair of brakes disposed on opposite faces of said documents;

h. each said pinch and brake means including a housing, a rocker arm and resilient means, said rocker arm pivotally mounted to said housing by said resilient means, actuator means operatively connected to said housing and rocker arm for pivoting said rocker arm, said actuated means having first and second states, said idler capstan mounted to said rocker arm at one end thereof, one of said brakes mounted to said rocker arm at an opposite end thereof, said document frictionally engaged between said idler and drive capstans and disengaged from said brakes when said actuator is in said first state, said document frictionally engaged between said brakes and disengaged from said idler and drive capstans when said actuator is in said second state.

12. A system for simultaneously printing at least two documents, said system comprising:

a. a drive motor;

b. means for selectively advancing each document, each said advancing means including first and second means including first and second means adapted for mutually exclusive engagement and disengagement with one of said documents, each said document being advanced when said first means is engaged and said second means is disengaged, each said document being stationary when said second means is engaged and said first means is disengaged, said advancing means operatively connected to said motor;

c. a print drum having at least two sets of raised characters disposed about its periphery in rows and arcuate columns;

d. ink impregnated means adapted for engagement with said print drum for transferring ink thereto;

e. at least two sets of ballistic element means, a first set of ballistic element means mounted in spaced registration with one set of characters and a second set of ballistic element means mounted in spaced registration with the other set of characters, each said set of ballistic element means having energized and deenergized states;

f. third means electrically communicating with each said advancing means for controlling each said first and second means;

g. fourth means electrically communicating with said third means and each set of ballistic element means for controlling the state of each said set of ballistic element means, said fourth means including a plurality of data comparators and a plurality of ballistic element controls, one each of said plurality of data comparators and one each of said plurality of ballistic elements controls being associated with one each of said rows of characters;

h. encoder means coupled to said print drum for generating selected signals representing the position of each said character, said encoder means electrically connected to said third means;

i. each said advancing means moving its respective document to a first position between said print drum means and ballistic element means in response to signals generated by said third means;

j. said fourth means receiving signals from said third means and, in response thereto, generating signals for energizing selected ones of said ballistic element means, said signals received from said third means being responsive to said selected signals generated by said encoder means;

k. portions of each said document in registration with an energized ballistic element means being pressed against the character in spaced registration with said energized ballistic element means, whereby the character is printed on said documents;

l. severing means electrically communicating with said third means, said severing means responsive to a first signal generated by said third means, said severing means operating to sever said printed documents; and m. dispensing means operatively connected to said motor and electrically communicating with said third means, said dispensing means operating to engage said documents, said documents dispensed from said system by said dispensing means when severed by said severing means.

* * * * *